US005527214A

United States Patent [19]

Estabrook

[11] Patent Number: 5,527,214

[45] Date of Patent: Jun. 18, 1996

[54] ROUGHING FINISHING HONING TOOL WITH PUSH/PULL EXPANSION MECHANISM

[75] Inventor: Mark R. Estabrook, Rockford, Ill.

[73] Assignee: Barnes International, Inc., Rockford, Ill.

[21] Appl. No.: 224,818

[22] Filed: Apr. 8, 1994

[51] Int. Cl.[6] ..... B24B 5/40

[52] U.S. Cl. ..... 451/470; 451/472; 451/474; 451/476

[58] Field of Search ..... 451/121, 124, 451/155, 470–478

[56] References Cited

U.S. PATENT DOCUMENTS

| | | | |
|---|---|---|---|
| 2,304,930 | 12/1942 | Klein | 451/474 |
| 2,777,257 | 1/1957 | Johnson | 451/478 |
| 2,790,278 | 4/1957 | Smith | 451/478 |
| 3,550,331 | 12/1970 | Watts | 451/474 |
| 3,727,352 | 4/1973 | Palazzi | 451/476 |
| 4,434,588 | 3/1984 | Wada et al. | 451/478 |

*Primary Examiner*—Maurina T. Rachuba
*Attorney, Agent, or Firm*—Leydig, Voit & Mayer, Ltd.

[57] ABSTRACT

The tool includes a body which supports angularly spaced roughing hones and angularly spaced finishing hones for radially inward and outward movement between collapsed and expanded positions. Expansion of the roughing hones is effected by axially spaced ramps when a rod is moved linearly in one direction while expansion of the finishing hones is effected by additional axially spaced ramps when the rod is shifted linearly in the other direction. By turning an adjusting nut from the free end of the tool body, the axial spacing between the ramps of the roughing hones may be changed for purposes of adjusting the inclination of the roughing hones. A second adjusting nut coaxial with the first nut may also be turned from the free end of the tool body to change the axial spacing between the ramps of the finishing hones and thereby effect adjustment of the inclination of the finishing hones.

6 Claims, 4 Drawing Sheets

ROUGHING FINISHING HONING TOOL WITH PUSH/PULL EXPANSION MECHANISM

BACKGROUND OF THE INVENTION

This invention relates generally to a honing tool having a body carrying a set of angularly spaced roughing hones and a set of angularly spaced finishing hones.

The hones of each set are supported by the body to move generally radially inwardly and outwardly between collapsed and expanded positions. When a push/pull rod is shifted linearly in one direction, axially spaced ramps act against one set of hones to move the latter to their expanded positions. Upon movement of the rod in the opposite direction, additional axially spaced ramps cause the finishing hones to move to their expanded positions.

More particularly, the invention relates to a honing tool for honing so-called blind bores (i.e., a bore having a closed end) or for honing counterbores. Those portions of the hones that remove material adjacent the closed end of a blind bore or adjacent the bottom of a counterbore are subjected to greater pressure and wear than the remaining lengths of the hones. In order to keep the bore or counterbore of uniform diameter along its entire length, it is necessary to periodically adjust the inclination of the hones in order to differentially set out the end portions which are subject to greatest wear and thereby compensate for such wear.

In prior honing tools having only a single set of hones, the axially spaced adjusting ramps are circumferentially continuous frustums. Adjustment of the inclination of the hones usually is achieved by manually rotating one of the frustums on a mounting screw to cause that frustum to thread along the screw and thereby change the axial spacing between the frustums. In tools having both roughing and finishing hones, however, the expansion ramps for one set of hones are interleaved angularly with the ramps for the other set. Accordingly, it is not possible to adjust one set of ramps independently of the interleaved set by rotating the ramps.

SUMMARY OF INVENTION

The general aim of the present invention is to provide a new and improved honing tool having both roughing and finishing hones whose inclination may be quickly and easily changed by rotary adjustments made from the free end of the tool but without rotating the expansion ramps for the hones.

A more detailed object of the invention is to achieve the foregoing by providing adjusting mechanism which, when rotated, effects linear translation of ramps of a set relative to the axially spaced ramps of the set and relative to the ramps of the other set.

The invention also resides in the relatively simple and radially compact construction of the adjusting mechanism.

These and other objects and advantages of the invention will become more apparent from the following detailed description when taken in conjunction with the accompanying drawings.

Figures 1, 2, 9, 10, 11:
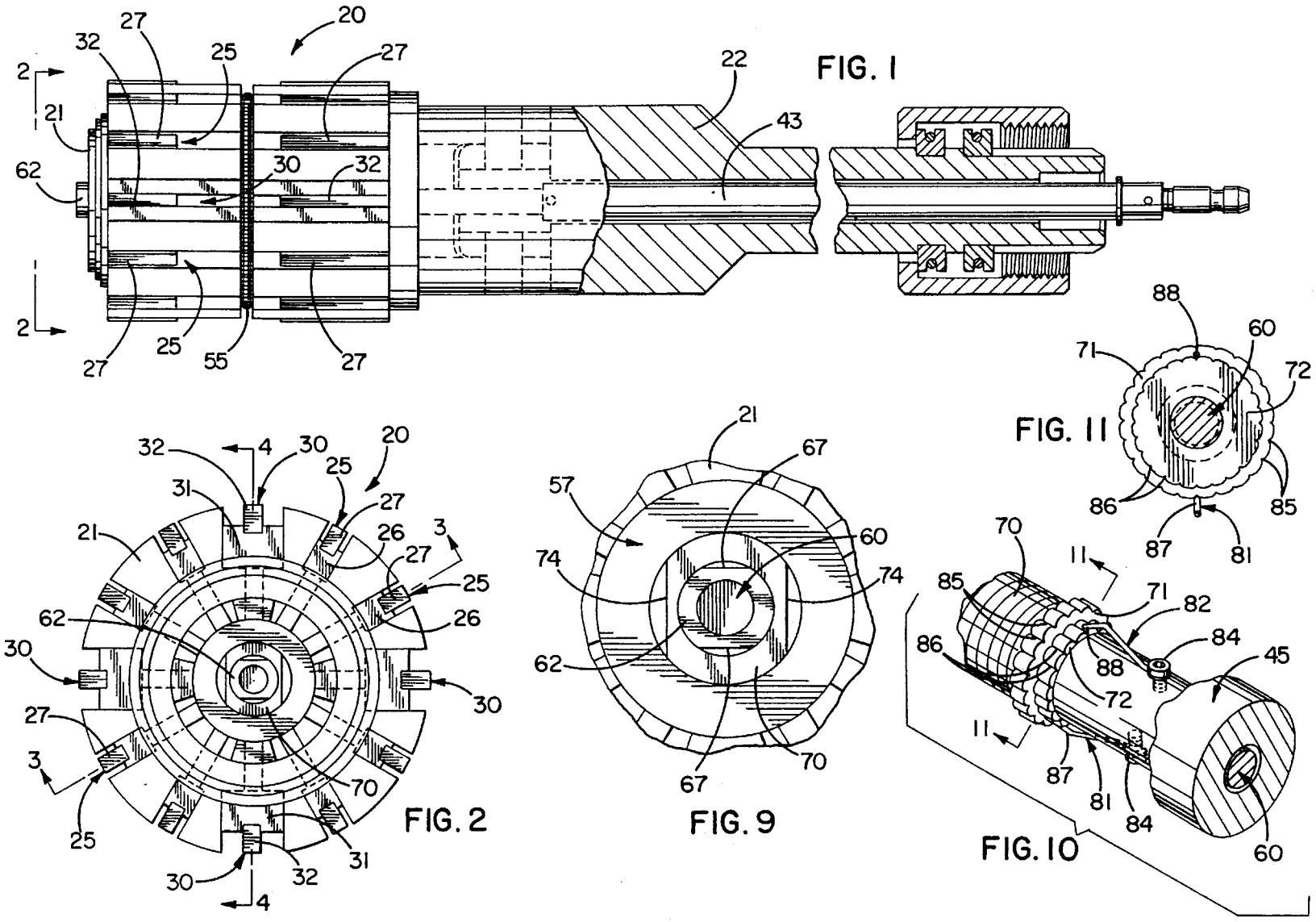
FIG. 1 is a side elevational view of a new and improved honing tool incorporating the unique features of the present invention, certain parts being broken away and shown in section.
FIG. 2 is an enlarged end view as seen along the line 2—2 of FIG. 1.
FIG. 9 is an enlarged view of certain components shown in FIG. 2.
FIG. 10 is a perspective view of a portion of the adjusting mechanism.
FIG. 11 is a cross-section taken along the line 11—11 of FIG. 10.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the invention has been shown in the drawings as incorporated in a honing tool 20 for smoothing and rounding the surfaces of bores in a metal workpiece (not shown) such as an engine block. The specific tool which has been shown is especially adapted to hone a blind bore having a cylindrical side wall and a substantially closed bottom or to hone a relatively deep counterbore having a cylindrical side wall located adjacent a bottom wall which, in turn, is formed with a smaller diameter bore. For simplicity, the tool will be described based on the assumption that it will be used in honing the side wall of a counterbore.

Figure 3:
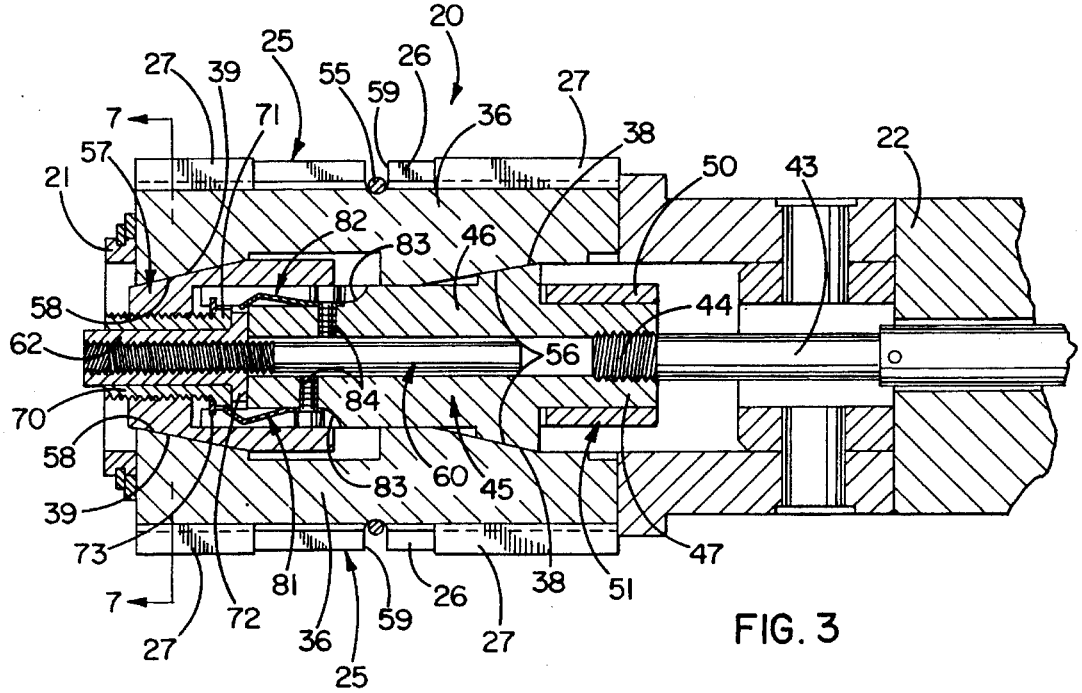
FIGS. 3 and 4 are fragmentary cross-sections, on a slightly reduced scale, taken substantially along the lines 3—3 and 4—4, respectively, of FIG. 2.

The honing tool 20 includes a generally cylindrical main body 21 (FIG. 2) adapted to be attached to a shank 22 (FIG. 1) which, in turn, is adapted to be rotated and reciprocated by a spindle (not shown). Carried by and spaced angularly around the body is a set of roughing hones 25 which are used to remove metal from the counterbore at a relatively rapid rate. In this particular instance, the tool includes eight roughing hones of conventional construction. Each comprises a holder 26 (FIG. 3) which supports a pair of axially spaced stones 27 made of abrasive grit, diamond particles or other well known abrading material. Instead of two axially spaced stones, each holder could support a single longer stone.

Figure 4:
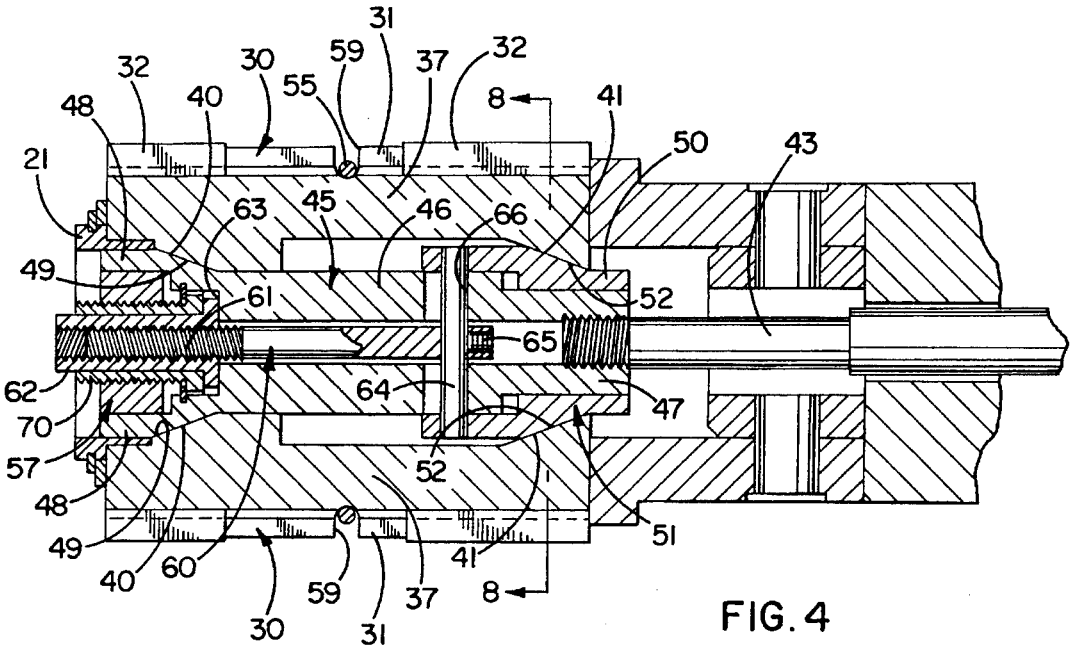

The tool 20 also includes a set of four angularly and equally spaced finishing hones 30 for smoothly polishing the side wall of the counterbore after the side wall has been roughly honed. Each finishing hone comprises a holder 31 (FIG. 4) supporting two axially spaced honing elements 32 which herein are stones made of finer abrasive grit than the roughing stones 27. Alternatively, the honing elements 32 could be brushes and each holder 31 could support a single longer element rather than two axially spaced elements.

Figure 7:
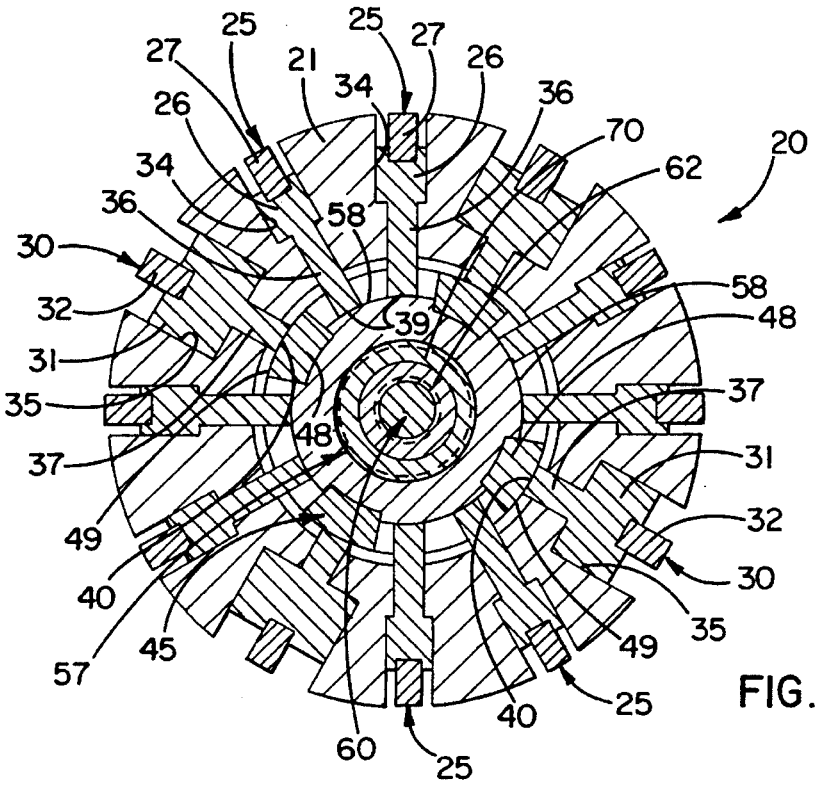
FIG. 7 is an enlarged cross-section taken substantially along the line 7—7 of FIG. 3.

As shown most clearly in FIG. 7, the holders 26 and 31 for the roughing hones 25 and the finishing hones 30 are supported in angularly spaced slots 34 and 35, respectively, formed in the body 21. Two equally spaced roughing hones are located between each pair of finishing hones. Each holder 26 and 31 is adapted to be moved radially outwardly and inwardly in its slot in order to enable the stones 27 and 32 to shift between radially collapsed and radially expanded positions. The holders 26 and 31 include expansion plates 36 and 37 (FIGS. 3, 4 and 7), respectively, which coact with an expansion mechanism to be described subsequently) in order to expand and collapse the hones. Each expansion plate 36 includes two axially spaced ramped surfaces 38 and 39 (FIG. 3) which slope radially inwardly upon progressing toward the free or leading end of the body 21. Each expansion plate 37 also is formed with two axially spaced ramped surfaces 40 and 41 (FIG. 4) but those surfaces slope radially inwardly upon progressing away from the leading end of the body.

Figure 5:
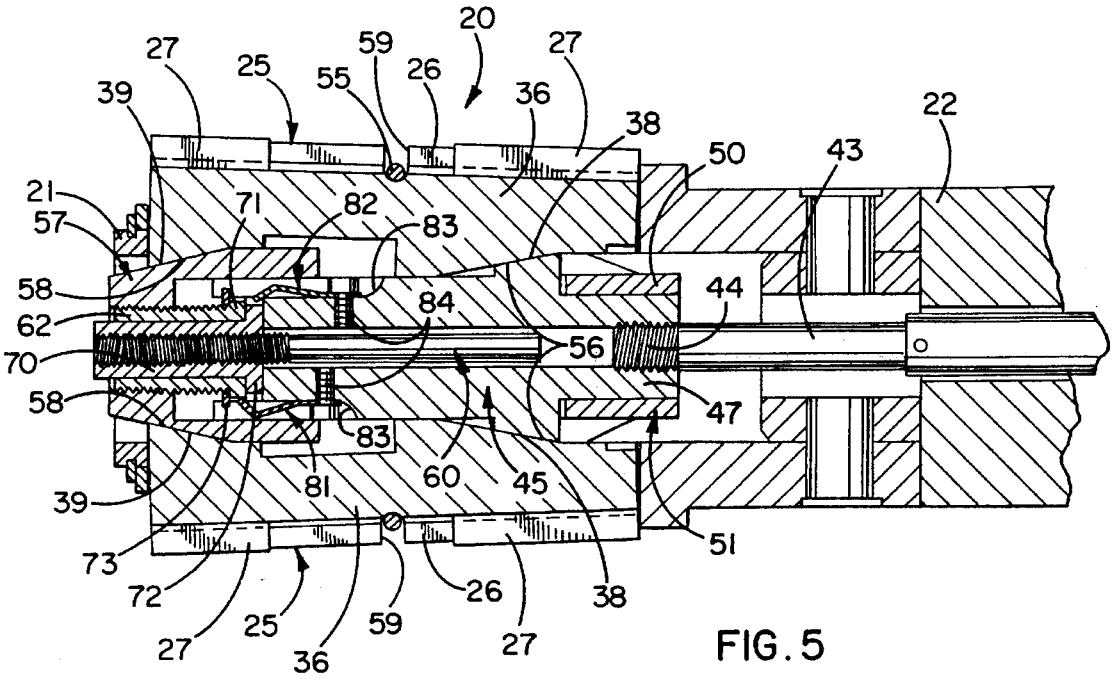
FIGS. 5 and 6 are views similar to FIGS. 3 and 4, respectively, but show certain components of the tool in adjusted positions.

To effect expansion and collapse of the hones 25 and 30, a push/pull rod 43 (FIGS. 1, 3 and 5) extends through the shank 22 and into the tool body 21. Threadably attached at 44 to the leading end portion of the rod 43 is a sleeve 45 having a cylindrical intermediate portion 46 and a reduced-diameter cylindrical end portion 47, the latter being located adjacent the rod 43. The opposite end portion of the sleeve 45 is defined by four angularly spaced fingers 48 (FIGS. 4 and 7) each having a ramped surface 49 which is sloped so as to progress radially outwardly upon progressing axially toward the free end of the body 21. The ramps 49 of the fingers 48 are located inwardly of and are disposed in engagement with the ramps 40 of the expansion plates 37 of the finishing stone holders 31.

Mounted on the reduced-diameter end portion 47 of the sleeve 45 is the hub 50 (FIG. 4) of a spider 51 having four angularly spaced ramps 52 which are inclined in the same direction as the ramps 40. The ramps 52 are located inwardly of and engage the ramps 40 of the expansion plates 37.

When the rod 43 is shifted axially to pull on the sleeve 45 (i.e., move the sleeve from left-to-right), the ramps 49 and 52 act against the ramps 40 and 41, respectively, and cam the finishing hones 30 radially outwardly to expanded positions in which the stones 32 engage the side wall of the counterbore. As the stones wear, the rod 43 is automatically shifted to pull the sleeve 45 further to the right and keep the stones in engagement with the side wall. Upon completion of the finishing operation, the sleeve 45 is Pushed to the left to a neutral position by the rod 43 and, as a result, the ramps 49 and 52 move out of camming engagement with the ramps 40 and 41, respectively. As an incident thereto, the finishing hones 30 are moved radially inwardly to their collapsed positions by a garter spring 55 (FIGS. 1 and 4) which encircles the holders 31 between the stones 32 and which is retained within notches 56 in the holders.

Figure 8:
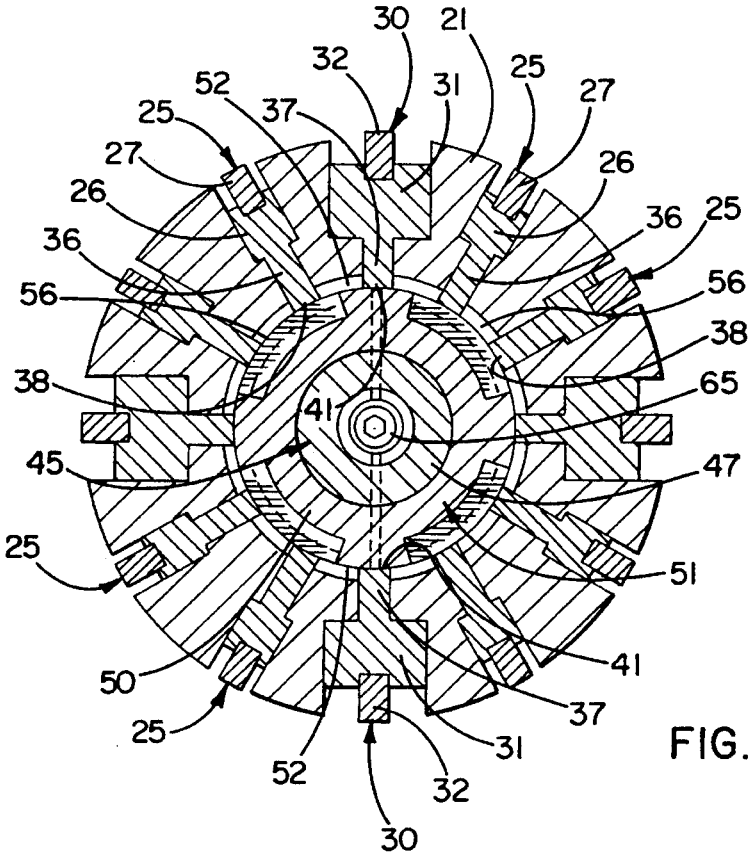
FIG. 8 is an enlarged cross-section taken substantially along the line 8—8 of FIG. 4.

Pushing of the sleeve 45 to the left beyond its neutral position effects expansion of the roughing hones 25. For this purpose, four angularly spaced ramps 56 (FIGS. 3 and 8) are formed integrally with and project outwardly from the sleeve 45 adjacent the end portion 47 thereof. The ramps 56 are interleaved angularly with the ramps 52 (see FIG. 8) and are sized and located such that one ramp 56 engages the ramps 38 of two adjacent roughing hones 25, the ramps 56 being located inwardly of and being inclined in the same direction as the ramps 38. Supported on the opposite end portion of the sleeve 45 is a spider 57 formed with four angularly spaced and outwardly projecting ramps 58 (FIGS. 3 and 7) which are interleaved angularly with the ramps 49. The ramps 58 are sloped in the same direction as the ramps 39 and are sized and located such that one ramp 58 engages two adjacent ramps 39.

Accordingly, pushing of the sleeve 45 to the left beyond its neutral position causes the ramps 56 and 58 to cam against the ramps 38 and 39, respectively, and expand the roughing hones 25 radially outwardly. As the rod 43 is retracted to pull the sleeve 45 toward its neutral position, the ramps 56 and 58 move out of camming engagement with the ramps 38 and 39 and, at that time, the garter spring 55 acts against the holders 26 to contract the roughing hones inwardly toward their collapsed positions. The holders 26 are formed with notches 59 (FIG. 3), similar to the notches 56 for receiving and retaining the garter spring.

From the foregoing, it will be apparent that provision is made for expanding and collapsing the roughing hones 25 by pushing and then pulling on the sleeve 45 with the rod 43 and for expanding and collapsing the finishing hones 30 by pulling and then pushing on the sleeve. With this arrangement, each set of hones is held in an inactive collapsed position while the other set of hones is engaging the side wall of the counterbore and while the active set is being expanded outwardly to compensate for wear.

When the tool 20 is being used to hone a counterbore, the end portions of the stones 27 and 32 adjacent the leading end of the tool are subjected to greater wear than the remaining length of the stones due to increased pressure exerted against the stones at the junction of the cylindrical side wall of the counterbore with the bottom thereof. As a result, the leading sets of stones tend to wear into a tapered shape. In order to compensate for the differential wear, it is necessary to periodically adjust the inclination of the stones so as to avoid leaving a taper at the aforementioned junction.

In accordance with the present invention, adjustment of the inclination of the hones 25 and 30 is effected easily and conveniently from the leading end of the tool 20 by making separate rotary adjustments which independently change the axial position of the spiders 51 and 57 while leaving the ramps 52 of the spider 51 interleaved with the ramps 56 of the sleeve 45 and while leaving the ramps 58 of the spider 57 interleaved with the ramps 49 of the sleeve.

More specifically, adjustment of the inclination of the finishing hones 30 is made possible in part by an elongated rod 60 (FIG. 4) located within the sleeve 45 and formed with a threaded end portion 61. An internally threaded element in the form of a sleeve 62 is screwed onto the threaded end portion of the rod 60 and is held against axial movement within a counterbore 63 in the sleeve 45. Extending radially through the opposite end portion of the rod 60 is a pin 64 whose end portions are tightly received in two diametrically spaced holes formed in the spider 51, the pin being secured to the rod 60 by a set screw 65 threaded into the end of the rod. A diametrically extending hole 66 formed in the sleeve 45 permits left-right movement of the pin relative to that sleeve.

Figure 6:
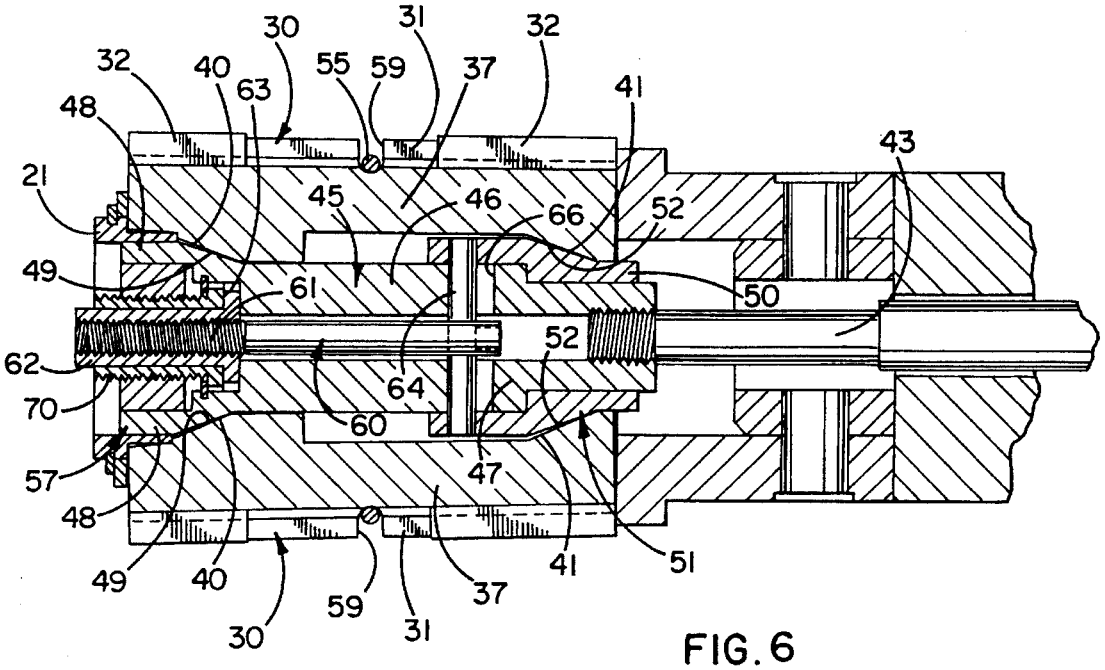

One end of the threaded sleeve 62 projects slightly beyond the free end of the tool body 21 and is formed with a pair of diametrically opposed flats 67 (FIG. 9) which may be engaged by a wrench or other driving tool. When the sleeve 62 is turned clockwise (FIG. 9), the rod 60 is advanced linearly from right-to-left and acts through the pin 64 to pull the spider 51 to the left along the sleeve 45 and thereby decrease the axial spacing between the ramps 52 and 49. As the ramps 52 move to the left relative to the coacting ramps 41, the garter spring 55 causes the finishing hones 30 to pivot inwardly about a fulcrum defined by the ramps 40 and 49. As a result, the finishing hones 30 are pivoted from the position shown in FIG. 4 toward the inclined position shown in FIG. 6 in order to compensate for the taper worn into the stones 32. It should be understood that movement of the hones from the position of FIG. 4 to the position of FIG. 6 has been shown on a greatly exaggerated basis for purposes of clarity and that, in actual practice, the movement during each incremental adjustment of the sleeve 62 will be far less than has been illustrated.

In order to change the inclination of the roughing hones 25, an externally threaded element or sleeve 70 (FIG. 3) is disposed in the counterbore 63 and is rotatably supported on the internally threaded sleeve 62. One end of the sleeve 70 is formed with a radially outwardly projecting flange 71 (FIG. 3) disposed in face-to-face relation with a similar flange 72 formed on the adjacent end of the sleeve 62 and engaging the bottom of the counterbore 63. A snap ring 73 in the counterbore 63 engages the flange 71 to trap the flange 72 against the bottom of the counterbore and thereby prevent axial movement of the sleeves 62 and 70.

The spider 57 is formed with an internally threaded bore and is screwed onto the sleeve 70. The end portion of the sleeve 70 opposite the flange 71 is formed with a pair of diametrically spaced wrenching flats 74 (FIG. 9). When the sleeve 70 is turned clockwise (FIG. 9), the spider 57 is advanced linearly from right-to-left along that sleeve. By virtue thereof, the axial spacing between the ramps 62 and 56 is increased and, as the ramps 62 advance, they cam against the ramps 39 to force the leading end portions of the hones 25 outwardly, the hones pivoting about a fulcrum defined by the ramps 38 and 56. Thus, the roughing hones are pivoted from the position shown in FIG. 3 to the position shown in FIG. 5 to locate the leading end portions of the stones 27 in position to compensate for the taper worn into the stones. Again, the extent of movement between FIG. 3 and FIG. 5 has been greatly exaggerated simply for purposes of illustration.

From the foregoing, it will be apparent that the inclination of the hones 25 and 30 may be adjusted from the leading end of the tool 20 simply by turning the sleeves 62 and 70, respectively. Because such turning moves the spiders 51 and 57 linearly without rotating the spiders, the ramps 52 and 58 of the spiders may accommodate the interleaved ramps 56 and 49 of the sleeve 45. Accordingly, inclination adjustment may be incorporated into the tool 20 while keeping the tool radially compact.

Detent means are provided for releasably retaining the sleeves 62 and 70 in fixed angular positions and for audibly indicating the extent of rotation of each sleeve. Herein, the detent means comprise cantilevered leaf springs 81 and 82 (FIG. 10) located in diametrically spaced slots 83 (FIG. 3) formed in the sleeve 45. Screws 84 fix the springs to the sleeve 45 and prevent the springs from rotating relative to the sleeve and the spiders 51 and 57.

The detent means further comprise angularly spaced notches 85 and 86 (FIG. 11) formed in the peripheries of the flanges 71 and 72, respectively, of the sleeves 70 and 62. The free end portion of the spring 81 is defined by a finger 87 which is seated releasably in one of the notches 85 while the free end portion of the spring 82 includes a finger 88 which seats releasably in one of the notches 86.

Normally, the resiliently biased fingers 87 and 88 coact with the notches 85 and 86 to restrict rotation of the sleeves 70 and 62. When either sleeve is turned by a wrench or other tool, the notches ratchet past the respective finger and produce audible clicks indicating the degree of rotation of the sleeve. Once the adjustment has been completed, the finger again seats in a notch to hold the sleeve rotationally stationary.

I claim:

1. A honing tool comprising a body adapted to be rotated about and reciprocated along a predetermined axis and having a free end, a set of roughing hones and a set of finishing hones spaced angularly around said body, each of said hones being supported by said body to move generally radially inwardly and outwardly between collapsed and expanded positions, a rod supported to shift back and forth along said axis and relative to said body, first sloped ramps and axially spaced second sloped ramps shiftable with said rod and operable to move one set of hones to their expanded positions when said rod is shifted relative to said body in one direction, third sloped ramps and axially spaced fourth sloped ramps shiftable with said rod and operable to move the other set of hones to their expanded positions when said rod is shifted relative to said body in the opposite direction, and selectively adjustable means accessible from the free end of said body for (a) adjusting the axial position of said first ramps relative to said second ramps without rotating either said first ramps or said second ramps thereby to change the inclination of said one set of hones and (b) for independently adjusting the axial position of said third ramps relative to said fourth ramps without rotating either said third ramps or said fourth ramps thereby to change the inclination of said other set of hones.

2. A honing tool as defined in claim 1 in which said means comprise a first threaded element threadably connected to said first ramps and rotatable about said axis to adjust said first ramps axially and linearly relative to said second ramps, said means further comprising a second threaded element threadably connected to said third ramps and rotatable about said axis to adjust said third ramps axially and linearly relative to said fourth ramps, each Of said threaded elements being rotatable by a driving tool applied to the element at a location adjacent the free end of said body.

3. A honing tool as defined in claim 2 in which said first element comprises an externally threaded sleeve rotatably supported on said second element, said second element comprising an internally threaded sleeve, means movable with said first ramps and having a threaded bore receiving said externally threaded sleeve, and an externally threaded rod threaded into said internally threaded sleeve and attached to said third ramps.

4. A honing tool as defined in claim 3 in which each of said sleeves includes an end portion located adjacent the free end of said body and having means for coupling non-rotatably with the driving tool.

5. A honing tool as defined in claim 4 in which each of said sleeves includes an opposite end portion with angularly spaced detents, and first and second detents fixed against rotation relative to said ramps and coacting with the detents of said externally threaded sleeve and said internally threaded sleeve, respectively, to releasably hold said sleeves against rotation relative to said ramps.

6. A honing tool as defined in claim 5 in which said angularly spaced detents comprise angularly spaced notches in said opposite end portions of said sleeves, said first and second detents comprising cantilevered spring fingers sized to fit into said notches.

* * * * *